US011085104B2

(12) United States Patent
Muhamad et al.

(10) Patent No.: US 11,085,104 B2
(45) Date of Patent: Aug. 10, 2021

(54) METHOD FOR MANUFACTURING NI-BASED HEAT-RESISTANT SUPERALLOY WIRE, AND NI-BASED HEAT-RESISTANT SUPER ALLOY WIRE

(71) Applicant: HITACHI METALS, LTD., Tokyo (JP)

(72) Inventors: Ainul Arafah Binti Muhamad, Tokyo (JP); Gang Han, Tokyo (JP); Remi Mukose, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 61 days.

(21) Appl. No.: 16/609,531

(22) PCT Filed: Jun. 26, 2018

(86) PCT No.: PCT/JP2018/024129
§ 371 (c)(1),
(2) Date: Oct. 30, 2019

(87) PCT Pub. No.: WO2019/004176
PCT Pub. Date: Jan. 3, 2019

(65) Prior Publication Data

US 2020/0063240 A1 Feb. 27, 2020

(30) Foreign Application Priority Data

Jun. 30, 2017 (JP) ..... JP2017-128929
Jun. 30, 2017 (JP) ..... JP2017-128930

(51) Int. Cl.

| | |
|---|---|
| ***C22C 19/05*** | (2006.01) |
| ***C22F 1/10*** | (2006.01) |
| ***C22C 19/00*** | (2006.01) |
| ***H01B 1/02*** | (2006.01) |
| ***H01B 13/00*** | (2006.01) |
| ***C21D 8/06*** | (2006.01) |

(52) U.S. Cl.
CPC ..... *C22C 19/056* (2013.01); *C21D 8/06* (2013.01); *C22C 19/007* (2013.01); *C22F 1/10* (2013.01); *H01B 1/02* (2013.01); *H01B 13/0016* (2013.01); *H01B 13/0036* (2013.01)

(58) Field of Classification Search
CPC ... C22C 19/056; C22C 19/057; C22C 19/055; C22F 1/10
See application file for complete search history.

(56) References Cited

U.S. PATENT DOCUMENTS

| | | | | |
|---|---|---|---|---|
| 2008/0166258 | A1 | 7/2008 | Tanimoto et al. | |
| 2009/0123328 | A1 | 5/2009 | Matsui et al. | |
| 2016/0160334 | A1* | 6/2016 | Imano | C22C 19/007 148/677 |

FOREIGN PATENT DOCUMENTS

| | | | |
|---|---|---|---|
| EP | 3 257 963 | A1 | 12/2017 |
| JP | 02-247365 | A | 10/1990 |
| JP | 03-133593 | A | 6/1991 |
| JP | 6-41634 | A | 2/1994 |
| JP | 2000-345268 | A | 12/2000 |
| JP | 2007-301635 | A | 11/2007 |
| JP | 2008-075171 | A | 4/2008 |
| WO | 2007/119847 | A1 | 10/2007 |
| WO | 2015/008343 | A1 | 1/2015 |
| WO | 2016/129485 | A1 | 8/2016 |

OTHER PUBLICATIONS

Communication dated Feb. 2, 2021 from the China National Intellectual Property Administration in CN Application No. 201880040683.X.
Akira Yoshinari, "Application and Properties of Ni-based Superalloy Castings", foundry engineering, Japan Foundry Engineering Society, Dec. 2001, pp. 834-839, vol. 73, No. 12.
"Compositions of Typical Cast Superalloys", [online], The Minerals, Metals & Materials Society, [searched on Apr. 25, 2018], the Internet <URL: http://www.tms.org/communities/ftattachments/superalloystable_castcomp.pdf>.
International Search Report for PCT/JP2018/024129, dated Sep. 18, 2018.
Communication dated Jul. 29, 2020, from the Japanese Patent Office in Application No. 2019-526919.

* cited by examiner

*Primary Examiner* — Jessee R Roe
(74) *Attorney, Agent, or Firm* — Sughrue Mion, PLLC

(57) ABSTRACT

Provided are: a method for manufacturing a Ni-based heat-resistant superalloy wire having excellent bending workability; and a Ni-based heat-resistant superalloy wire. The method for manufacturing a Ni-based heat-resistant superalloy wire comprises a rod preparation step for preparing a Ni-based heat-resistant superalloy rod; and a rod processing step in which plastic working having a working rate of 40% or less is repeated several times toward the axis from the circumferential surface of the rod at a temperature of 500° C. or lower until the cumulative working rate reaches 60% or more to reduce the cross-sectional area of the rod. A Ni-based heat-resistant superalloy wire obtained by the manufacturing method has a plastic worked or recrystallized microstructure.

8 Claims, 3 Drawing Sheets

METHOD FOR MANUFACTURING NI-BASED HEAT-RESISTANT SUPERALLOY WIRE, AND NI-BASED HEAT-RESISTANT SUPER ALLOY WIRE

CROSS REFERENCE TO RELATED APPLICATIONS

This application is a National Stage of International Application No. PCT/JP2018/024129 filed Jun. 26, 2018, claiming priority based on Japanese Patent Application No. 2017-128929 filed Jun. 30, 2017 and Japanese Patent Application No. 2017-128930 filed Jun. 30, 2017.

TECHNICAL FIELD

The present invention relates to a method of manufacturing a super heat resistant Ni-based alloy wire, and to the super heat resistant Ni-based alloy wire.

BACKGROUND ART

An engine of an aircraft or a gas turbine for power generation has been improved to have higher performance and reduced fuel consumption. Accordingly, a heat-resistant product used for these purposes has been required to have improved heat resistance (or high-temperature strength). A super heat resistant Ni-based alloy is often used for a material of the heat-resistant product (see Non Patent Literatures 1 and 2). The Ni-based alloy has higher heat resistance when a structure thereof includes has a larger amount of gamma prime phase which is an intermetallic compound mainly composed of $Ni_3Al$ and acts as a precipitation-strengthening phase. Alloys 713 and 939 (e.g., representatively expressed as IN713 and IN939, respectively) include large amounts of Al, Ti and Nb which are gamma-prime forming elements, and are such super heat resistant Ni-based alloys having high heat resistance include.

In recent years, it has been required that a heat-resistant product of the Ni-based alloy is repaired, for example by welding or the like or the product is produced by three-dimensional forming, for example by an additive manufacturing process with use of a laser or an electron beam as a heat source. Thus, a "wire" of the Ni-based alloy has been required as a raw material for the forming. The wire has a small diameter of, for example, not more than 5 mm, or further not more than 3 mm.

CITATION LIST

Non Patent Literature

NON PATENT LITERATURE 1: Akira Yoshinari, "Application and Properties of Ni-based Superalloy Castings", foundry engineering, Japan Foundry Engineering Society, December 2001, Vol. 73, No. 12, p. 834-839

NON PATENT LITERATURE 2: Compositions of Typical Cast Superalloys, [online], The Minerals, Metals & Materials Society, [searched on Apr. 25, 2018], the Internet <URL: http://www.tms.org/communities/ftattachments/superalloystable_castcomp.pdf>

SUMMARY OF INVENTION

Conventional super heat resistant Ni-based alloy wire has been provided in a form of single "bar" since the wire immediately broken when one attempts to bend it and has been difficult to be bent into a coil shape. Thus, when the Ni-based alloy wires were used to repair or produce a heat-resistant product, a new Ni-based alloy wire needed to be set every time the wire was consumed. Thus, the wire was intermittently supplied. If the Ni-based alloy wire can be bent into a coil shape, it is possible to provide the wire in a form of "coil" and to continuously feed it to supply the wire from the coil to improve work efficiency.

An object of the present invention is to provide a method of manufacturing a super heat resistant Ni-based alloy wire having improved bending workability, and to provide the super heat resistant Ni-based alloy wire.

The inventors have studied bending workability of a super heat resistant Ni-based alloy wire. As a result, they have found that improvement of tensile strength of the Ni-based alloy wire suppresses the breakage of the wire during the bending work and improves bending workability thereof. Then, they have found an effective manufacturing method of producing the Ni-based alloy wire and identified a structure thereof having the excellent bending workability. Thus, they have reached the present invention.

According to the present invention, provided is a method of manufacturing a super heat resistant Ni-based alloy wire. The method includes:

a bar material preparation step of preparing a bar material of a super heat resistant Ni-based alloy; and a bar material working step of plastically working the bar material to reduce a cross-sectional area of the bar material by compressing a peripheral surface toward an axis of the bar material, the working being performed multiple times until a cumulative working rate becomes not less than 60%, each working being performed at a working rate of not more than 40% multiple times at a temperature not higher than 500° C. Preferably, the working may be performed multiple times until a cumulative working rate becomes not less than 70%. Preferably, each working may be performed at a working rate of not more than 30%. In the bar material working step, the cross-sectional area of the bar material may be preferably reduced so that the bar material has a final wire diameter.

Preferably, the method may further include a heat treatment step of heat-treating, at a temperature higher than 500° C., the Ni-based alloy wire produced at the bar material working step.

Preferably, the Ni-based alloy may have a composition of a precipitation strengthening type such that an amount of precipitated gamma prime phase in equilibrium at 700° C. is not less than 35 mol %. An embodiment of the composition may preferably include, by mass %, 0 to 0.25% of C, 8.0 to 25.0% of Cr, 0.5 to 8.0% of Al, 0.4 to 7.0% of Ti, 0 to 28.0% of Co, 0 to 8.0% of Mo, 0 to 6.0% of W, 0 to 4.0% of Nb, 0 to 3.0% of Ta, 0 to 10.0% of Fe, 0 to 1.2% of V, 0 to 1.0% of Hf, 0 to 0.300% of B, 0 to 0.300% of Zr, and the balance of Ni and impurities.

A specific embodiment of the composition may include, by mass %, 0 to 0.2% of C, 8.0 to 22.0% of Cr, 2.0 to 8.0% of Al, 0.4 to 7.0% of Ti, 0 to 28.0% of Co, 2.0 to 7.0% of Mo, 0 to 6.0% of W, 0 to 4.0% of Nb, 0 to 3.0% of Ta, 0 to 10.0% of Fe, 0 to 1.2% of V, 0 to 1.0% of Hf, 0 to 0.300% of B, 0 to 0.300% of Zr, and the balance of Ni and impurities.

Another specific embodiment of the composition may include, by mass %, 0 to 0.2% of C, 20.0 to 25.0% of Cr, 0.5 to 5.0% of Al, 1.0 to 6.0% of Ti, 10.0 to 28.0% of Co, 0 to 8.0% of Mo, 0.5 to 5.0% of W, 0.1 to 3.0% of Nb, 0 to 3.0% of Ta, 0 to 10.0% of Fe, 0 to 1.2% of V, 0 to 1.0% of Hf, 0 to 0.300% of B, 0.010 to 0.300% of Zr, and the balance of Ni and impurities.

According to the present invention, also provided is a super heat resistant Ni-based alloy wire having a composition of a precipitation strengthening type such that an amount of precipitated gamma prime phase in equilibrium at 700° C. is not less than 35 mol %, and having a plastically worked structure or a recrystallization structure, wherein the composition includes, by mass %, 0 to 0.25% of C, 8.0 to 25.0% of Cr, 0.5 to 8.0% of Al, 0.4 to 7.0% of Ti, 0 to 28.0% of Co, 0 to 8.0% of Mo, 0 to 6.0% of W, 0 to 4.0% of Nb, 0 to 3.0% of Ta, 0 to 10.0% of Fe, 0 to 1.2% of V, 0 to 1.0% of Hf, 0 to 0.300% of B, 0 to 0.300% of Zr, and the balance of Ni and impurities.

An embodiment of the composition may include, by mass %, 0 to 0.2% of C, 8.0 to 22.0% of Cr, 2.0 to 8.0% of Al, 0.4 to 7.0% of Ti, 0 to 28.0% of Co, 2.0 to 7.0% of Mo, 0 to 6.0% of W, 0 to 4.0% of Nb, 0 to 3.0% of Ta, 0 to 10.0% of Fe, 0 to 1.2% of V, 0 to 1.0% of Hf, 0 to 0.300% of B, 0 to 0.300% of Zr, and the balance of Ni and impurities.

Another embodiment of the composition may include, by mass %, 0 to 0.2% of C, 20.0 to 25.0% of Cr, 0.5 to 5.0% of Al, 1.0 to 6.0% of Ti, 10.0 to 28.0% of Co, 0 to 8.0% of Mo, 0.5 to 5.0% of W, 0.1 to 3.0% of Nb, 0 to 3.0% of Ta, 0 to 10.0% of Fe, 0 to 1.2% of V, 0 to 1.0% of Hf, 0 to 0.300% of B, 0.010 to 0.300% of Zr, and the balance of Ni and impurities.

Preferably, the Ni-based alloy wire is not broken when a bending displacement reaches 50 mm in a cantilever beam bending test, wherein the bending test includes: preparing a super heat resistant Ni-based alloy wire having a length of 150 mm; fixing a portion 25 mm distant from one end of the wire; and applying a load at a portion 25 mm distant from the other end of the wire.

According to the present invention, a method of manufacturing a super heat resistant Ni-based alloy wire having improved bending workability and the super heat resistant Ni-based alloy wire are provided.

DESCRIPTION OF EMBODIMENTS

Figure 1:
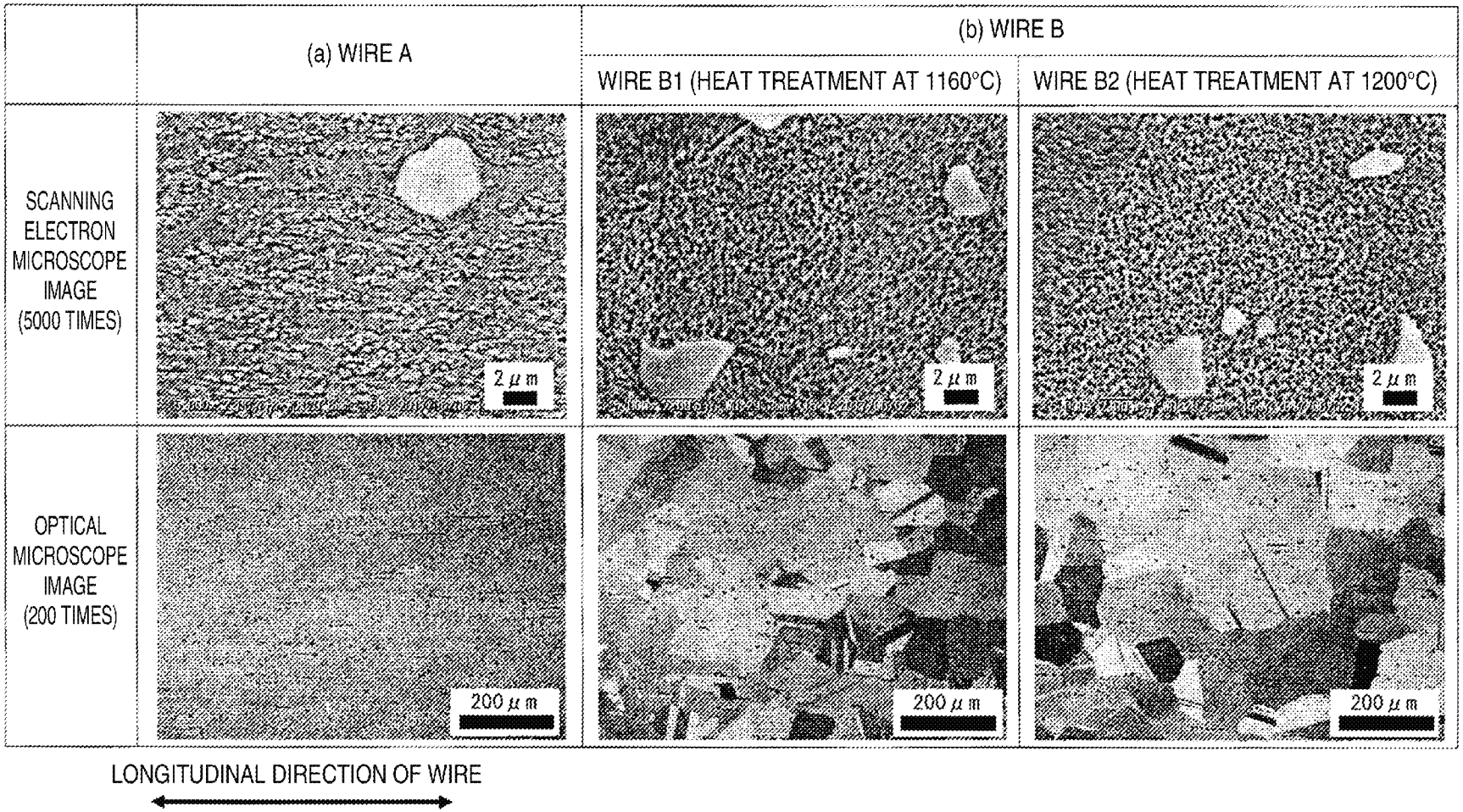
FIG. 1 is a drawing substituting for a photograph, showing an example of a cross-sectional microstructure of a super heat resistant Ni-based alloy wire produced by an embodiment method according to the present invention.

Conventional super heat resistant Ni-based alloy wires have lacked sufficient bending workability, and some of the wires have been immediately broken by an attempt to bend the wires. This is because the conventional Ni-based alloy wires have been produced by casting and have had a brittle cast structure. The bending workability has been less improved, even when such a cast wire has been further subjected to minor processing for shaping or to heat treatment for eliminating the cast structure.

The inventors have studied the bending workability of the super heat resistant Ni-based alloy wire. As a result, they have found that the Ni-based alloy wire can have tensile strength and improved bending workability by eliminating the cast structure. The inventors have found that it is effective to achieve it to largely deform the Ni-based alloy to a wire shape.

Thus, the present invention provides a method of manufacturing a super heat resistant Ni-based alloy wire including: a bar material preparation step of preparing a bar material of a super heat resistant Ni-based alloy; and a bar material working step of plastically working the bar material to reduce a cross-sectional area of the bar material by compressing a peripheral surface toward an axis of the bar material, the working being performed multiple times until a cumulative working rate becomes not less than 60%, each working being performed at a working rate of not more than 40% at a temperature not higher than 500° C. In addition to these steps, the method may further include a heat treatment step of heat-treating, at a temperature higher than 500° C., the Ni-based alloy wire produced in the bar material working step.

In order to applicable for various uses, the Ni-based alloy wire produced by the method preferably has, for example, a wire diameter of not more than 10 mm, more preferably not more than 6 mm, still more preferably not more than 5 mm, and further still more preferably not more than 4 mm. Furthermore, the wire preferably has a wire diameter of not more than 3.5 mm, more preferably not more than 3 mm, still more preferably not more than 2.5 mm, and further still more preferably not more than 2 mm. In order to improve the bending workability thereof by eliminating the cast structure and provide sufficient tensile strength, it is effective to prepare a raw material (bar material) having a greater cross-sectional area in relation to that of the wire and is subjected to high deformation plastic working (i.e., plastic working at a high working rate).

The "high deformation plastic working" can be conducted by means such as swaging processing or dice drawing processing with use of a cassette roller dice, a hole dice or the like. The swaging processing is a method of forging a peripheral surface of a bar material with rotating a plurality of dices surrounding an entire circumference of the bar material. Accordingly, it is possible to compress a cross-sectional area of the bar material while applying pressure uniformly and evenly from the entire circumference of the bar material. Thus, the swaging processing is an effective means of plastic working the Ni-based alloy which has been difficult to be plastically worked, while preventing cracks or flaws.

In order to achieve the "high deformation plastic working", the bar material is plastically worked at a high working rate of "not less than 60%". The working rate is preferably not less than 70%, and more preferably not less than 80%. The working rate is defined as a value calculated by a formula: $[(A_0-A_1)/A_0]\times100(\%)$, as a relationship between a cross-sectional area $A_0$ of a bar material (also referred to as "wire material") before plastic working and a cross-sectional area $A_1$ of the wire material (wire) after plastic worked. According to the high working rate, the wire can have, for example, a small final wire diameter such as not more than 3.5 mm, not more than 3 mm, not more than 2.5 mm, or not more than 2 mm. There is no need to determine an upper limit of the working rate of not less than 60%. For example, the upper limit of the working rate may be set to be less than 100%, not more than 98%, or not more than 95% according to a final wire diameter of the wire.

According to the method of the present invention, the plastic working at a working rate of "not less than 60%" is performed by multiple time workings (i.e., in multiple passes). With regard to the term "pass", "one pass" indicates one plastic working through a single (or a pair of) dice or the like in a case of swaging processing or dice wire drawing processing described above. When the plastic working is performed multiple times, it is important to perform each plastic working at a low working rate of "not more than 40%". Thus, the plastic working (bar material working step) according to the present invention is "gradual (stepwise) plastic working" since plastic working at a working rate of not more than 40% is performed multiple times until a cumulative working rate becomes not less than 60%. The gradual plastic working can eliminate a cast structure entirely through the wire. The low working rate in the plastic working performed each time can further prevent occurrence of flaws on a surface of the wire. The gradual plastic working is preferably performed each time at a working rate of not more than 30%.

There is no need to determine a lower limit of the working rate in the plastic working performed each time. In terms of working efficiency and the like, the lower limit may be, for example, approximately 10%. Alternatively, the plastic working may be performed at a working rate of not less than 15% once or more in the multiple times plastic working.

Furthermore, it is effective according to the present invention to perform the plastic working each time in a low temperature range to prevent recovery or recrystallization in the multiple times plastic working, in order to provide tensile strength to the Ni-based alloy wire of a final shape which has been finished all the passes of the plastic working. In the present invention, the plastic working is performed at a temperature not higher than 500° C., preferably not higher than 300° C., more preferably not higher than 100° C., and still more preferably not higher than 50° C. (e.g., at room temperature). In this regard, the low temperature plastic working for preventing recovery or recrystallization is also effective to maintain a "plastically worked structure" or a "recrystallization structure" (described later) of the Ni-based alloy wire according to the present invention.

No heat treatment is necessary between the multiple times of the plastic working. The heat treatment indicates a heat treatment in a high temperature range in which recovery or recrystallization occurs, such as at a temperature higher than 500° C. The heat treatment may be performed as appropriate to the Ni-based alloy wire which has been subjected to the plastic working multiple times to have a final shape.

The Ni-based alloy wire can have tensile strength through the above method. It can be confirmed that the wire obtains the tensile strength, by observing that a metal structure of the wire is not a brittle "cast structure" but a "plastically worked structure" produced through high plastic deformation or a "recrystallization structure" produced by heat-treating the plastically worked structure as described above. The metal structure of the Ni-based alloy can be adjusted to have the plastically worked structure or the recrystallization structure through the above method.

The "plastically worked structure" of the super heat resistant Ni-based alloy wire according to the present invention is, for example, a structure deformed in a direction along the plastic working (i.e., a structure extending in a longitudinal direction of the wire) due to the high deformation plastic deformation. Such an alloy has, for example, a hardness of not less than 500 HV. It has, for example, a hardness of less than 700 HV. In a super heat resistant Ni-based alloy wire having a composition described later, for example, the plastically worked structure can be identified by the presence of a "collective flow" of gamma prime phase observed in a metal structure. FIG. 1 (*a*) shows photomicrographs of a structure of a super heat resistant Ni-based alloy wire produced in an example according to the present invention, which is observed at a cross section including a central axis in a longitudinal direction of the wire. A horizontal direction in FIG. 1 (*a*) (i.e., a direction indicated by an arrow in FIG. 1) is the longitudinal direction of the wire. In a scanning electron microscope image (hereinafter referred to as "SEM image") at an observation magnification of 5000 times in FIG. 1 (*a*), a collection of dispersed small grains (light color portion) is a "gamma prime phase" (a single large lump observed at an upper right portion in FIG. 1 (*a*) is a "carbide" lamp). It is observed that a "collective flow" of gamma prime phase extends along the longitudinal direction of the wire.

In an optical microscope image (hereinafter referred to as "optical microscope image") at an observation magnification of 200 times in FIG. 1 (*a*), an approximately continuous string-shaped collection (dark color portion) is a collection of "carbides". It is also observed that a "collective flow" of carbides extends approximately parallel to the longitudinal direction of the wire. When many carbides are present in the metal structure, the plastically worked structure can also be identified by a collective flow of carbides.

The "recrystallization structure" of the super heat resistant Ni-based alloy wire according to the present invention is defined as a structure including grown grains which is, for example, produced by heat-treating the plastically worked structure at a recrystallization temperature (e.g., at a temperature higher than 500° C.). FIG. 1 (*b*) shows photomicrographs of a structure of a super heat resistant Ni-based alloy wire produced in an example according to the present invention, which was observed at a cross section including a central axis in a longitudinal direction of the wire. A horizontal direction in FIG. 1 (*b*) (i.e., a direction indicated by the arrow in FIG. 1) is the longitudinal direction of the wire. FIG. 1 (*b*) shows a structure of the wire produced through the heat-treating of the wire in FIG. 1 (*a*) at a predetermined recrystallization temperature. In an optical microscope image at a magnification of 200 times in FIG. 1 (*b*), approximately straight lines are clearly observed at a boundary between a dark color portion and a light color portion in an entire field of view. The lines are "grain boundaries". A region surrounded by the grain boundaries can be defined as a "recrystallized grain". The grain boundary can also be observed in an SEM image at an observation magnification of 5000 times in FIG. 1 (*b*) (large lumps are "carbides").

In the super heat resistant Ni-based alloy wire according to the present invention, the "a recrystallization structure" can be indicated by its grain size. In this case, the recrystallization structure can be indicated as having a cross-sectional structure, for example, "including grains having a maximum length of not less than 100 μm" (a practical upper limit of the maximum length is approximately 1500 μm). Such an alloy has a hardness of less than 500 HV for example, and has a hardness of not less than 400 HV for example.

Even in the Ni-based alloy wire having the recrystallization structure, the collective flow of carbides in the grains or over the grain boundary can be observed in the metal structure (optical microscope image in FIG. 1 (*b*)) when many carbides are present in the metal structure of the wire. The collective flow of carbides shows that the metal structure has been produced "by heat-treating the plastically worked structure at the recrystallization temperature". This shows that the Ni-based alloy wire having the recrystallization structure has been plastically worked into a wire shape.

According to the present invention, the Ni-based alloy wire is less likely to be broken even when being bent, since a brittle cast structure can be eliminated by adjusting the metal structure thereof to be the "plastically worked structure or recrystallization structure". Thus, bending workability of the Ni-based alloy wire is improved. The effect of improving the bending workability is achieved by providing tensile strength to the Ni-based alloy wire. Accordingly, the super heat resistant Ni-based alloy wire according to the present invention has the plastically worked structure or the recrystallization structure, which means that the wire has tensile strength.

With regard to such excellent bending workability, for example, the Ni-based alloy wire according to the present invention is not broken even when a bending displacement reaches 50 mm in a cantilever bending test. The bending test is performed as follows: a wire having a length of 150 mm is prepared, and a portion 25 mm distant from one end of the wire is fixed and a load is applied to a portion 25 mm distant from the other end of the wire.

The super heat resistant Ni-based alloy wire according to the present invention is used, for example, by being melted for repair or three-dimensional forming of a heat-resistant product. In this case, the melted wire is solidified, and is then heat-treated, if necessary, to be completed as a heat-resistant product. In order to maintain the heat resistance of the product and provide excellent bending workability to the wire to be used to produce the product, it is preferable that the Ni-based alloy wire (i.e., bar material before being subjected to plastic working) according to the present invention has a composition of a precipitation strengthening type such that the amount of precipitated gamma prime phase in equilibrium at 700° C. is "not less than 35 mol %" for example. The amount of precipitated gamma prime phase in equilibrium indicates a stable amount of precipitated gamma prime phase in a thermodynamic equilibrium state. In order to improve the heat resistance, it is effective that the amount of precipitated gamma prime phase in equilibrium at 700° C. is not less than 35 mol %. The amount of precipitated gamma prime phase in equilibrium at 700° C. is more preferably not less than 40 mol %, and still more preferably not less than 50 mol %. In particular, the amount of precipitated gamma prime phase in equilibrium at 700° C. is preferably not less than 60 mol %, more preferably not less than 63 mol %, still more preferably not less than 66 mol %, and further still more preferably not less than 68 mol %. There is no need to determine an upper limit of the amount of precipitated gamma prime phase in equilibrium at 700° C., but its practical value is approximately 75 mol %.

In the Ni-based alloy according to the present invention, the amount of precipitated gamma prime phase in equilibrium, expressed in "mol %", is determined by a composition of the Ni-based alloy. The amount in "mol %" can be obtained by analysis through thermodynamic equilibrium calculation. The amount can be obtained correctly and easily by the analysis using various kinds of thermodynamic equilibrium calculation software.

The Ni-based alloy of a precipitation strengthening type, the amount of precipitated gamma prime phase of which in equilibrium at 700° C. is "not less than 35 mol %", is preferably adjusted to have a basic composition, for example, including, by mass %, 0 to 0.25% of C, 8.0 to 25.0% of Cr, 0.5 to 8.0% of Al, 0.4 to 7.0% of Ti, and the balance of Ni and impurities. If necessary, the basic composition may further include, by mass %, one or more elements selected from 0 to 28.0% of Co, 0 to 8.0% of Mo, 0 to 6.0% of W, 0 to 4.0% of Nb, 0 to 3.0% of Ta, 0 to 10.0% of Fe, 0 to 1.2% of V, 0 to 1.0% of Hf, 0 to 0.300% of B, and 0 to 0.300% of Zr. Effects of each element of the above composition will be described below (mass % is simply expressed as "%").

<C: 0 to 0.25%>

Carbon (C) has an effect of increasing strength of grain boundaries. However, a large amount of carbon increases coarse carbides to deteriorate ductility during plastic working. Therefore, the carbon content is preferably not more than 0.25%, more preferably not more than 0.2%, still more preferably not more than 0.1%, further still more preferably not more than 0.05%, and particularly preferably not more than 0.02%. The coarse carbide may become a starting point of cracking when the Ni-based alloy wire is bent. Accordingly, the restriction of carbon is also preferable for improving bending workability of the Ni-based alloy wire. When carbon is not intentionally added (i.e., as an impurity level in a raw material), a lower limit of carbon may be 0 mass %.

On the other hand, since carbon has an effect of increasing strength, it is effective to provide tensile strength to the Ni-based alloy wire, and can contribute to improve bending workability of the Ni-based alloy wire. Therefore, in order to achieve the effect, the carbon content is preferably not less than 0.001%, more preferably not less than 0.003%, still more preferably not less than 0.005%, and particularly preferably not less than 0.01%.

<Cr: 8.0 to 25.0%>

Chromium (Cr) improves oxidation resistance and corrosion resistance. However, an excessive amount of Cr results in formation of a brittle phase such as a σ (sigma) phase, for example, to deteriorate hot workability during preparation of a bar material. Therefore, the Cr content is preferably 8.0 to 25.0%.

<Al: 0.5 to 8.0%>

Aluminum (Al) forms a gamma prime phase, and improves high-temperature strength. However, an excessive amount of Al makes a metal structure of a heat-resistant product unstable at a high temperature. Therefore, the Al content is preferably 0.5 to 8.0%.

<Ti: 0.4 to 7.0%>

Titanium (Ti) forms a gamma prime phase and increases high-temperature strength through solid solution strengthening of the gamma prime phase, similarly to Al. However, an excessive amount of Ti makes a metal structure of a heat-resistant product unstable at a high temperature. Therefore, the Ti content is preferably 0.4 to 7.0%.

The balance of the Ni-based alloy other than the above elements is Ni, while inevitable impurities may be included. If necessary, the basic composition may further include elements below.

<Co: 0 to 28.0%>

Cobalt (Co) is an optional element which improves stability of a metal structure of a heat-resistant product. However, an excessive amount of Co generates a brittle Co intermetallic compound. Therefore, if necessary, the Co content is preferably not more than 28.0%. When Co is not intentionally added (i.e., it is impurity in a raw material), a lower limit of Co may be 0 mass %.

<Mo: 0 to 8.0%>

Molybdenum (Mo) is an optional element which contributes to solid solution strengthening of a matrix and improves high-temperature strength. However, an excessive amount of Mo results in formation of an intermetallic compound phase to deteriorate high-temperature strength. Therefore, if necessary, the Mo content is preferably not more than 8.0%. When Mo is not intentionally added (i.e., it is impurity in a raw material), a lower limit of Mo may be 0 mass %.

<W: 0 to 6.0%>

Tungsten (W) is an optional element which contributes to solid solution strengthening of a matrix, similarly to Mo. However, an excessive amount of W results in formation of a harmful intermetallic compound phase to deteriorate high-temperature strength. Therefore, if necessary, the W content is preferably not more than 6.0%. When W is not intentionally added (i.e., it is impurity in a raw material), a lower limit of W may be 0 mass %.

<Nb: 0 to 4.0%>

Niobium (Nb) is an optional element which forms a gamma prime phase and increases high-temperature strength through solid solution strengthening of the gamma prime phase, similarly to Al and Ti. However, an excessive amount of Nb results in formation of a harmful δ (delta) phase to deteriorate the effect of Ti of improving high-temperature strength. Therefore, if necessary, the Nb content is preferably not more than 4.0%. When Nb is not intentionally added (i.e., it is impurity in a raw material), a lower limit of Nb may be 0 mass %.

<Ta: 0 to 3.0%>

Tantalum (Ta) is an optical element which forms a gamma prime phase and increases high-temperature strength through solid solution strengthening of the gamma prime phase, similarly to Al and Ti. However, an excessive amount of Ta makes the gamma prime phase unstable at high temperature to deteriorate the intrinsic effect of Ta of improving high-temperature strength. Therefore, if necessary, the Ta content is preferably not more than 3.0%, more preferably not more than 2.5%, still more preferably not more than 2.25%, further still more preferably not more than 2.0%, and particularly preferably not more than 1.75%. When Ta is not intentionally added (i.e., it is impurity in a raw material), a lower limit of Ta may be 0 mass %.

In order to achieve the above effect of the Ta content, the Ta content is preferably not less than 0.3%, more preferably not less than 0.6%, still more preferably not less than 0.9%, and further still more preferably not less than 1.1%.

<Fe: 0 to 10.0%>

Iron (Fe) is an optional element which may be included instead of expensive Ni or Co and is effective in reducing cost of the alloy. However, an excessive amount of Fe results in formation of a brittle phase such as a σ phase, for example, to deteriorate hot workability during preparation of a bar material. Therefore, if necessary, the Fe content is preferably not more than 10.0%, more preferably not more than 8.0%, still more preferably not more than 5.0%, and further still more preferably not more than 2.0%. When Fe is not intentionally added (i.e., it is impurity in a raw material), a lower limit of Fe may be 0 mass %.

In order to achieve the above effect of the Fe content, the Fe content is preferably not less than 0.1%, more preferably not less than 0.4%, still more preferably not less than 0.6%, and further still more preferably not less than 0.8%.

<V: 0 to 1.2%>

Vanadium (V) is an optical element which is effective for solid solution strengthening of a matrix and generation of carbides to increase grain boundary strength. However, an excessive amount of vanadium results in formation of an unstable intermetallic compound in a metal structure to deteriorate high-temperature strength. Therefore, if necessary, the vanadium content is preferably not more than 1.2%, more preferably not more than 1.0%, still more preferably not more than 0.8%, and further still more preferably not more than 0.7%. When vanadium is not intentionally added (i.e., it is impurity in a raw material), a lower limit of vanadium may be 0 mass %.

In order to achieve the above effect of the vanadium content, the vanadium content is preferably not less than 0.1%, more preferably not less than 0.2%, still more preferably not less than 0.3%, and further still more preferably not less than 0.5%.

<Hf: 0 to 1.0%>

Hafnium (Hf) is an optional element which is effective for improvement of oxidation resistance of the alloy and generation of carbides to increase grain boundary strength. However, an excessive amount of Hf results in formation of oxide and such a phase that is unstable at a high temperature during a manufacturing process, and adversely affects productivity and high-temperature dynamic performance. Therefore, if necessary, the Hf content is preferably not more than 1.0%, more preferably not more than 0.7%, still more preferably not more than 0.5%, and further still more preferably not more than 0.3%. When Hf is not intentionally added (i.e., as an impurity level in a raw material), a lower limit of Hf may be 0 mass %.

In order to achieve the above effect of the Hf content, the Hf content is preferably not less than 0.02%, more preferably not less than 0.05%, still more preferably not less than 0.1%, and further still more preferably not less than 0.15%.

<B: 0 to 0.300%>

Boron (B) is an optional element which increases grain boundary strength and improves creep strength and ductility. However, an excessive amount of boron causes not a little decrease in melting point of the alloy, and adversely affects high-temperature strength. Therefore, if necessary, the boron content is preferably not more than 0.300%, more preferably not more than 0.200%, still more preferably not more than 0.100%, further still more preferably not more than 0.050%, and particularly preferably not more than 0.020%. When boron is not intentionally added (i.e., as an impurity level in a raw material), a lower limit of boron may be 0 mass %.

In order to achieve the above effect of the boron content, the boron content is preferably not less than 0.002%, more preferably not less than 0.003%, still more preferably not less than 0.004%, and further still more preferably not less than 0.005%.

<Zr: 0 to 0.300%>

Zirconium (Zr) is an optional element which has an effect of increasing grain boundary strength, similarly to boron. However, an excessive amount of Zr causes not a little decrease in melting point of the alloy, and adversely affects high-temperature strength. Therefore, if necessary, the Zr content is preferably not more than 0.300%. When Zr is not intentionally added (i.e., it is impurity in a raw material), a lower limit of Zr may be 0 mass %.

Among the above basic compositions, following composition "A", for example, is preferable for improving the heat resistance of the Ni-based alloy, since it has a large amount (e.g., not less than 40 mol %) of precipitated gamma prime phase in equilibrium at 700° C. The composition "A" includes, by mass %, 0 to 0.2% of C, 8.0 to 22.0% of Cr, 2.0 to 8.0% of Al, 0.4 to 7.0% of Ti, 0 to 28.0% of Co, 2.0 to 7.0% of Mo, 0 to 6.0% of W, 0 to 4.0% of Nb, 0 to 3.0% of Ta, 0 to 10.0% of Fe, 0 to 1.2% of V, 0 to 1.0% of Hf, 0 to 0.300% of B, 0 to 0.300% of Zr, and the balance of Ni and impurities.

In the composition "A", one or more of the elements are more preferably to be in a range below.

<Cr> A lower limit of Cr is preferably 9.0%, and more preferably 9.5%. An upper limit of Cr is preferably 18.0%, more preferably 16.0%, and still more preferably 14.0%.

<Al> A lower limit of Al is preferably 2.5%, more preferably 3.5%, and still more preferably 4.5%. An upper limit of Al is preferably 7.5%, more preferably 7.0%, and still more preferably 6.5%.

<Ti> A lower limit of Ti is preferably 0.45%, and more preferably 0.50%. An upper limit of Ti is preferably 5.0%, more preferably 3.0%, and still more preferably 1.0%.

<Co> A lower limit of Co is preferably 1.0%, more preferably 3.0%, still more preferably 8.0%, and further still more preferably 10.0%. An upper limit of Co is preferably 18.0%, more preferably 16.0%, and still more preferably 13.0%.

<Mo> A lower limit of Mo is preferably 2.5%, more preferably 3.0%, and still more preferably 3.5%. An upper limit of Mo is preferably 6.0%, more preferably 5.5%, and still more preferably 5.0%.

<W> A lower limit of W is preferably 0.8%, and more preferably 1.0%. An upper limit of W is preferably 5.5%, more preferably 5.0%, and still more preferably 4.5%.

<Nb> A lower limit of Nb is preferably 0.5%, more preferably 1.0%, still more preferably 1.5%, and further still more preferably 2.0%. An upper limit of Nb is preferably 3.5%, more preferably 3.0%, and still more preferably 2.5%.

<Zr> A lower limit of Zr is preferably 0.001%, more preferably 0.005%, still more preferably 0.010%, and further still more preferably 0.030%. An upper limit of Zr is preferably 0.250%, more preferably 0.200%, and still more preferably 0.150%.

Among the above basic compositions, following composition "B", for example, ensures conventional casting ability. The composition "B" includes, by mass %, 0 to 0.2% of C, 20.0 to 25.0% of Cr, 0.5 to 5.0% of Al, 1.0 to 6.0% of Ti, 10.0 to 28.0% of Co, 0 to 8.0% of Mo, 0.5 to 5.0% of W, 0.1 to 3.0% of Nb, 0 to 3.0% of Ta, 0 to 10.0% of Fe, 0 to 1.2% of V, 0 to 1.0% of Hf, 0 to 0.300% of B, 0.010 to 0.300% of Zr, and the balance of Ni and impurities. Therefore, the Ni-based alloy wire of the present invention having the composition "B" is preferable for use in conventional repair and production of a heat-resistant product.

In the composition "B", one or more of the elements are more preferably to be in a range below.

<Cr> A lower limit of Cr is preferably 20.5%, more preferably 21.0%, and still more preferably 21.5%. An upper limit of Cr is preferably 24.5%, more preferably 24.0%, and still more preferably 23.5%.

<Al> A lower limit of Al is preferably 0.8%, more preferably 1.0%, still more preferably 1.25%, and further still more preferably 1.5%. An upper limit of Al is preferably 4.0%, more preferably 3.5%, still more preferably 3.0%, and further still more preferably 2.5%.

<Ti> A lower limit of Ti is preferably 1.5%, more preferably 2.0%, still more preferably 2.5%, and further still more preferably 3.0%. An upper limit of Ti is preferably 5.5%, more preferably 5.0%, still more preferably 4.5%, and further still more preferably 4.2%.

<Co> A lower limit of Co is preferably 12.0%, more preferably 14.0%, still more preferably 16.0%, and further still more preferably 17.0%. An upper limit of Co is preferably 27.0%, more preferably 25.0%, still more preferably 23.0%, and further still more preferably 21.0%.

<Mo> A lower limit of Mo is preferably 0.1%, more preferably 0.3%, still more preferably 0.5%, and further still more preferably 0.7%. An upper limit of Mo is preferably 5.0%, more preferably 3.0%, and still more preferably 1.0%.

<W> A lower limit of W is preferably 0.7%, more preferably 1.2%, still more preferably 1.5%, and further still more preferably 1.7%. An upper limit of W is preferably 4.5%, more preferably 4.0%, still more preferably 3.5%, and further still more preferably 3.0%.

<Nb> A lower limit of Nb is preferably 0.2%, more preferably 0.3%, still more preferably 0.5%, and further still more preferably 0.7%. An upper limit of Nb is preferably 2.5%, more preferably 2.25%, still more preferably 2.00%, and further still more preferably 1.50%.

<Zr> A lower limit of Zr is preferably 0.020%, more preferably 0.030%, still more preferably 0.050%, and further still more preferably 0.070%. An upper limit of Zr is preferably 0.250%, more preferably 0.200%, still more preferably 0.170%, and further still more preferably 0.150%.

According to the present invention, it is possible to provide a method of manufacturing a super heat resistant Ni-based alloy wire having improved bending workability, as well as to provide the super heat resistant Ni-based alloy wire. Thus, all the planned passes to compress the cross-sectional area of the bar material can be conducted until the wire has a final wire diameter, for example in the bar material working step according to the present invention, thereby it is also possible to provide a super heat resistant Ni-based alloy wire, as a "product", having improved bending workability. Such wire may be provided in a coil shape.

Example 1

A bar material having a diameter of 6.0 mm was produced from an ingot having a composition (corresponding to Alloy 939) in Table 1 (bar material preparation step). The bar material had a hardness of 366 HV. At this time, an amount of precipitated gamma prime phase in equilibrium at 700° C. in the composition in Table 1 was obtained with use of thermodynamic equilibrium calculation software "JMatPro (Version 8.0.1, manufactured by Sente Software Ltd.)". The content of each element in Table 1 was input into the software. As a result of calculation, the amount of precipitated gamma prime phase in equilibrium at 700° C. was 40 mol %.

TABLE 1

| Composition (mass %) | | | | | | | | | |
|---|---|---|---|---|---|---|---|---|---|
| C | Cr | W | Co | Al | Ti | Nb | Ta | Zr | balance* |
| 0.15 | 22.5 | 2.0 | 19.0 | 1.9 | 3.7 | 1.0 | 1.4 | 0.1 | Ni |

*including impurities

The bar material was subjected to swaging processing at a cumulative working rate of 83% at a room temperature (25° C.) to produce a super heat resistant Ni-based alloy wire A (with a wire diameter of 2.5 mm) of an example according to the present invention (bar material working step). The swaging processing was performed in multiple passes. A hole size of a dice used for the passes in the swaging processing was sequentially reduced by 0.5 mm so as to perform gradual plastic working (i.e., swaging processing in 7 passes in total) such that a working rate in each pass of the swaging processing was not more than 40%. No heat treatment was performed between the passes. Table 2 shows a working rate in each pass together with a cumulative working rate.

The wire A had good surface state although extremely minor surface flaws were observed due to a relatively high working rate in the 7th pass (final pass). The wire A had a hardness of 539 HV.

TABLE 2

| Pass in swaging processing | Wire diameter (mm) | Working rate (%) | Cumulative working rate (%) |
|---|---|---|---|
| 1 | 6.0 (Bar material)→5.5 | 16 | 16 |
| 2 | 5.5→5.0 | 17 | 31 |
| 3 | 5.0→4.5 | 19 | 44 |
| 4 | 4.5→4.0 | 21 | 56 |
| 5 | 4.0→3.5 | 23 | 66 |
| 6 | 3.5→3.0 | 27 | 75 |
| 7 | 3.0→2.5 (Wire A) | 31 | 83 |

<Structure of Ni-Based Alloy Wire>

FIG. 1 (*a*) shows photomicrographs (SEM image and optical microscope image) of a cross-sectional microstructure of the wire A. It was taken at a portion, in a cross section of a halved portion of the wire A cut in a longitudinal direction thereof, at a position ½D distant from a surface toward a central axis of the wire A (D indicates a wire diameter of the wire A). The horizontal direction in FIG. 1 (*a*) (i.e., direction indicated by the arrow in FIG. 1) corresponds to the longitudinal direction of the wire. From the SEM image (at an observation magnification of 5000 times) in FIG. 1 (*a*) of the cross-sectional structure of the wire A, a collective flow of gamma prime phase extending along the longitudinal direction of the wire was observed. Thus, it was confirmed that the wire A produced as the example according to the present invention had a plastically worked structure. It was also confirmed from the optical microscope image (at an observation magnification of 200 times) in FIG. 1 (*a*) by the fact that carbides observed in the cross-sectional structure of the wire A formed a string-shaped collective flow.

Subsequently, the wire A having the plastically worked structure was heat-treated at temperatures of 1160° C. or 1200° C. (heat treatment step) to produce respective two types of wires, i.e., a wire B1 (heat treated at a temperature of 1160° C.) and a wire B2 (heat treated at a temperature of 1200° C.). FIG. 1 (*b*) shows photomicrographs (SEM images and optical microscope images) of cross-sectional microstructures of the wires B1 and B2. A position and direction of the cross-sectional microstructures were the same as those in FIG. 1 (*a*). As shown in the SEM images (at an observation magnification of 5000 times) and the optical microscope images (at an observation magnification of 200 times) in FIG. 1 (*b*), the cross-sectional structures of the wires B1 and B2 had large grown grains due to recrystallization. A maximum length of the grains was 270 μm in the wire B1 and 418 μm in the wire B2. As shown in the optical microscope images in FIG. 1 (*b*), a string-shaped collective flow of carbides was observed in the grains and over a grain boundary in the cross-sectional structures of the wires B1 and B2. The collective flow corresponded to those observed in the optical microscope image in FIG. 1 (*a*). Thus, it was confirmed that the wires B1 and B2 produced as the examples according to the present invention were produced by heat-treating the wire A at the recrystallization temperature and had a recrystallization structure.

<Tensile Strength of Ni-Based Alloy Wire>

Tensile strength was measured for the wire A as plastically-worked and the wires B1 and B2 heat-treated of the wire A at temperatures of, respectively, 1160° C. and 1200° C. At this time, wire materials in Table 2 (which may be also referred to as wires) which were in the processing of the production of the wire A was also measured of the tensile strength. As the wire materials, three types of wire materials, i.e., a wire material in a 4th pass (at a cumulative working rate of 56%), a wire material in a 5th pass (at a cumulative working rate of 66%), and a wire material in a 6th pass (at a cumulative working rate of 75%) were selected. The wire material in the 6th pass was heat-treated at temperatures of 1160° C. or 1200° C. to produce respective wire materials, and tensile strength of the produced wire materials was also measured.

The tensile test was conducted as follows. The wires (including the wire materials) having respective wire diameters were used as tensile test specimens in its wire form, and a length of 100 mm of the wire was pulled in a longitudinal direction thereof at a test temperature of 22° C. (at normal temperature) at a strain rate of 0.1 per second. The tensile strength was measured as a value obtained by dividing, by an original cross-sectional area of the wire, a maximum load that the wire withstood until the wire was broken when the wire was pulled in the longitudinal direction. Table 3 shows the results together with hardness of each wire.

TABLE 3

| | Cumulative working rate (%) | Wire diameter (mm) | As plastically-worked Hardness (HV) | As plastically-worked Tensile strength (MPa) | Heat treatment at 1160° C. Hardness (HV) | Heat treatment at 1160° C. Tensile strength (MPa) | Heat treatment at 1200° C. Hardness (HV) | Heat treatment at 1200° C. Tensile strength (MPa) |
|---|---|---|---|---|---|---|---|---|
| Wire material (4th pass) | 56 | 4.0 | 562 | 1878 | — | — | — | — |
| Wire material (5th pass) | 66 | 3.5 | 551 | 2077 | — | — | — | — |
| Wire material (6th pass) | 75 | 3.0 | 560 | 2079 | 479 | 1347 | 459 | 1339 |
| Wires A, B1 and B2 | 83 | 2.5 | Wire A | | Wire B1 | | Wire B2 | |
| | | | 539 | 2082 | 449 | 1340 | 467 | 1331 |

It was seen from Table 3 that, as the cumulative working rate was increased, the tensile strength of the wire was increased. When the cumulative working rate reached approximately 60%, a cast structure was sufficiently eliminated in the structure of the wire and the tensile strength of the wire was not less than 2000 MPa. When the wire was heat-treated, the hardness of the wire was reduced. However, due to the elimination of the cast structure, the tensile strength of the wire was maintained at a sufficient value (e.g., tensile strength of not less than 1000 MPa) corresponding to the reduced hardness.

<Bending Workability of Ni-Based Alloy Wire>

The wires A, B1 and B2 as the example according to the present invention were subjected to a cantilever bending test. In the bending test, a wire having a length of 150 mm was prepared, and a position 25 mm distant from one end and a position 25 mm distant from another end were set respectively as a fixed position and a loading point (i.e., a distance from the fixed position to the loading point was 100 mm). As a result of the bending test, none of the wires A, B1 and B2 was broken even when a bending displacement reached 50 mm.

Furthermore, an ingot including 0.008% of B in addition to the composition in Table 1 and an ingot including 1.0% of Fe in addition to the composition in Table 1 were produced. As a result of calculation in the same manner as the above calculation, the amount of precipitated gamma prime phase in equilibrium at 700° C. was 40 mol % for the both ingot compositions.

Wires were produced from the both ingots in the same manufacturing process as the wires A, B1 and B2 and also had a plastically worked structure or a recrystallization structure similar to those of the wires A, B1 and B2. Then, the wires were subjected to the cantilever bending test, and as a result, none of the wires was broken when a bending displacement reached 50 mm.

Example 2

From an ingot having a composition (corresponding to 939 alloy) in Table 4, a bar material having a diameter of 6.0 mm was produced (bar material preparation step). The bar material had a hardness of 385 HV. For the composition in Table 4, the calculation in the same manner as in Example 1 taught that the amount of precipitated gamma prime phase in equilibrium at 700° C. was 40 mol %. Then, the bar material was subjected to swaging processing in the same condition as in Example 1 (wire A) to produce a super heat resistant Ni-based alloy wire C (with a wire diameter of 2.5 mm) of an example according to the present invention (bar material working step). The wire C had good surface state although extremely minor surface flaws were observed due to a relatively high working rate in a 7th pass (final pass). The wire C had a hardness of 561 HV.

TABLE 4

| Composition (mass %) | | | | | | | | | |
|---|---|---|---|---|---|---|---|---|---|
| C | Cr | W | Co | Al | Ti | Nb | Ta | Zr | balance* |
| 0.015 | 22.5 | 2.0 | 19.0 | 1.9 | 3.7 | 1.0 | 1.4 | 0.1 | Ni |

*including impurities

<Structure of Ni-Based Alloy Wire>

Figure 2:
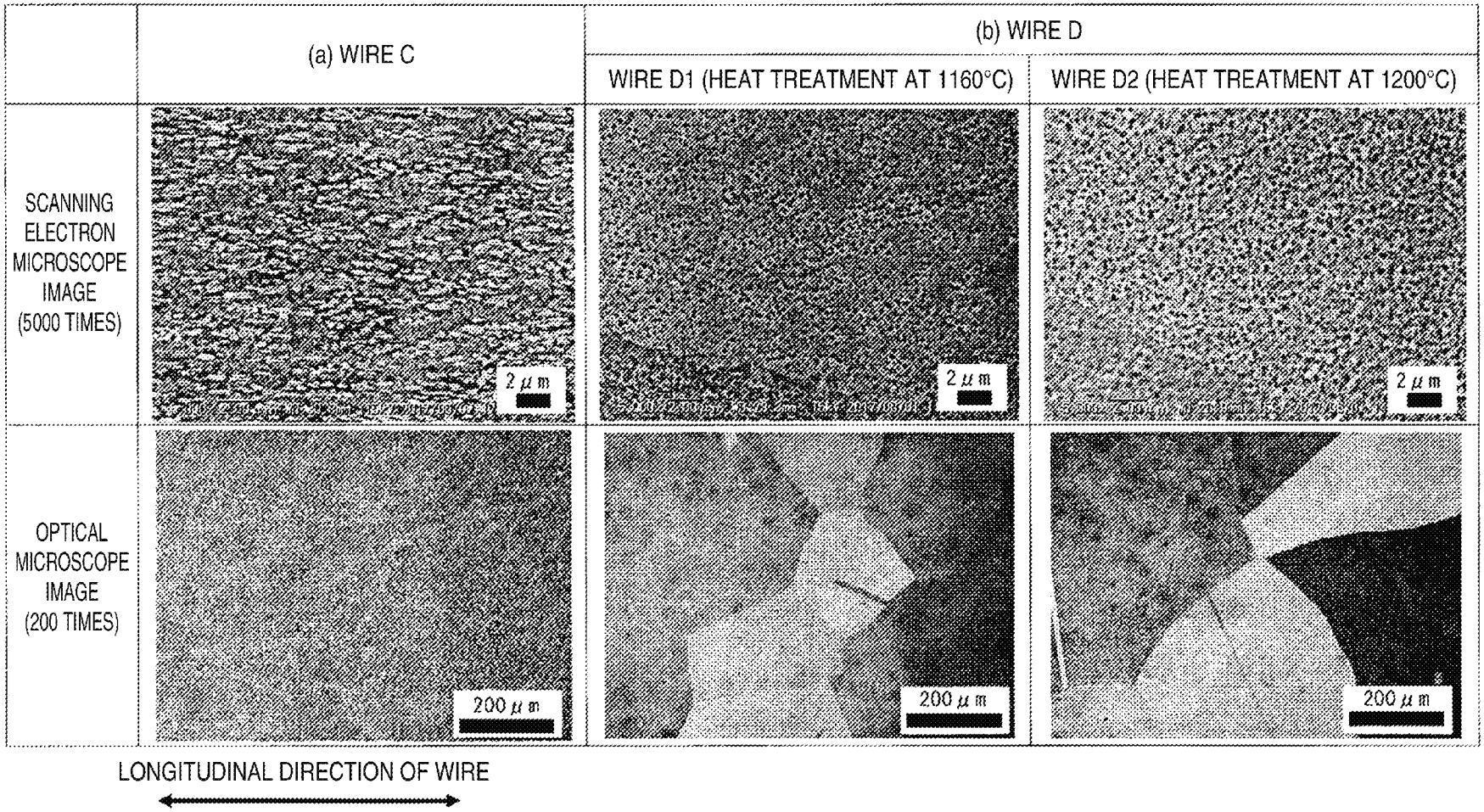
FIG. 2 is a drawing substituting for a photograph, showing an example of a cross-sectional microstructure of a super heat resistant Ni-based alloy wire produced by another embodiment method according to the present invention.

FIG. 2 (*a*) shows photomicrographs (SEM image and optical microscope image) of a cross-sectional microstructure of the wire C. A position and direction of the cross-sectional microstructure were the same as those in FIG. 1 (*a*). From the SEM image (at an observation magnification of 5000 times) in FIG. 2 (*a*), a collective flow of gamma prime phase was observed in the cross-sectional structure of the wire C. Thus, it was confirmed that the wire C produced in the example according to the present invention had a plastically worked structure. Due to its low carbon content and the like, the presence of carbides was not clearly observed in the optical microscope image (at an observation magnification of 200 times) of the wire C in FIG. 2 (*a*).

Subsequently, the wire C having the plastically worked structure was heat-treated at temperatures of 1160° C. and 1200° C. to produce two types of wires, i.e., a wire D1 (heat treatment at a temperature of 1160° C.) and a wire D2 (heat treatment at a temperature of 1200° C.) (heat treatment step). FIG. 2 (*b*) shows photomicrographs (SEM images and optical microscope images) of cross-sectional microstructures of the wires D1 and D2. A position and direction of the cross-sectional microstructures were the same as those in FIG. 1 (*b*). As shown in the SEM images (at an observation magnification of 5000 times) and the optical microscope images (at an observation magnification of 200 times) in FIG. 2 (*b*), the cross-sectional structures of the wires D1 and D2 had large grown grains due to recrystallization. A maximum length of the grains was approximately 1000 μm in both the wires D1 and D2. Thus, it was confirmed that the wires D1 and D2 produced in the example according to the present invention had a recrystallization structure.

<Tensile Strength of Ni-Based Alloy Wire>

Tensile strength of the wires C, D1 and D2 was measured. The tensile strength was also measured in three types of wire materials (may also referred to as wires), i.e., a wire material in a 4th pass (at a cumulative working rate of 56%), a wire material in a 5th pass (at a cumulative working rate of 66%), and a wire material in a 6th pass (at a cumulative working rate of 75%) which were in the respective passes during the production of the wire C. The wire material in the 6th pass was heat-treated at temperatures of 1160° C. and 1200° C. to produce wire materials, and tensile strength of the produced wire materials was also measured. The tensile test was performed in the same manner as in Example 1. Table 5 shows the results together with hardness of each of the wires.

TABLE 5

| | Cumulative working rate (%) | Wire diameter (mm) | As plastically-worked Hardness (HV) | As plastically-worked Tensile strength (MPa) | Heat treatment at 1160° C. Hardness (HV) | Heat treatment at 1160° C. Tensile strength (MPa) | Heat treatment at 1200° C. Hardness (HV) | Heat treatment at 1200° C. Tensile strength (MPa) |
|---|---|---|---|---|---|---|---|---|
| Wire material (4th pass) | 56 | 4.0 | 574 | 2028 | — | — | — | — |
| Wire material (5th pass) | 66 | 3.5 | 579 | 2153 | — | — | — | — |
| Wire material (6th pass) | 75 | 3.0 | 573 | 2127 | 432 | 1199 | 436 | 1119 |
| Wires C, D1 and D2 | 83 | 2.5 | Wire C | | Wire D1 | | Wire D2 | |
| | | | 561 | 2184 | 457 | 1184 | 447 | 1132 |

It is confirmed from Table 5 that, as the cumulative working rate was increased, the tensile strength of the wire tended to be increased. When the cumulative working rate reached approximately 60%, a cast structure was sufficiently eliminated in the structure of the wire and the tensile strength of the wire was not less than 2100 MPa. When the wire was heat-treated, the hardness of the wire was reduced.

However, due to the elimination of the cast structure, the tensile strength of the wire was maintained at a sufficient value (e.g., tensile strength of not less than 1000 MPa) corresponding to the reduced hardness.

<Bending Workability of Ni-Based Alloy Wire>

The wires C, D1 and D2 of the example according to the present invention were each subjected to the cantilever bending test in the same manner as in Example 1. As a result of the bending test, none of the wires C, D1 and D2 was broken even when a bending displacement reached 50 mm.

Furthermore, an ingot including 0.008% of B in addition to the composition in Table 4 and an ingot including 1.0% of Fe in addition to the composition in Table 4 were produced. As a result of calculation in the same manner as the above calculation, the amount of precipitated gamma prime phase in equilibrium at 700° C. was 40 mol % for the both ingot compositions.

Wires produced from the both ingots in the same manufacturing process as the wires C, D1 and D2 also had a plastically worked structure or a recrystallization structure similar to those of the wires C, D1 and D2. Then, the wires were subjected to the cantilever bending test, and none of the wires was broken when a bending displacement reached 50 mm.

Example 3

From an ingot having a composition (corresponding to 713 alloy) in Table 6, a bar material having a diameter of 6.0 mm was produced (bar material preparation step). The bar material had a hardness of 418 HV. The calculation in the same manner as in Example 1 taught that the amount of precipitated gamma prime phase in equilibrium at 700° C. was 69 mol % for the composition in Table 6. Then, the bar material was subjected to swaging processing until a 6th pass (at a cumulative working rate of 75%) in the same condition as in Example 1 (wire A) to produce a super heat resistant Ni-based alloy wire E (with a wire diameter of 3.0 mm) of an example according to the present invention (bar material working step). The wire E had good surface state since no surface flaw was observed. The wire E had a hardness of 578 HV.

TABLE 6

| Composition (mass %) | | | | | | | | | |
|---|---|---|---|---|---|---|---|---|---|
| C | Cr | Mo | Al | Ti | Nb | Fe | Zr | B | balance* |
| 0.015 | 12.0 | 4.5 | 5.9 | 0.6 | 2.1 | 1.1 | 0.1 | 0.01 | Ni |

*including impurities

<Structure of Ni-Based Alloy Wire>

Figure 3:
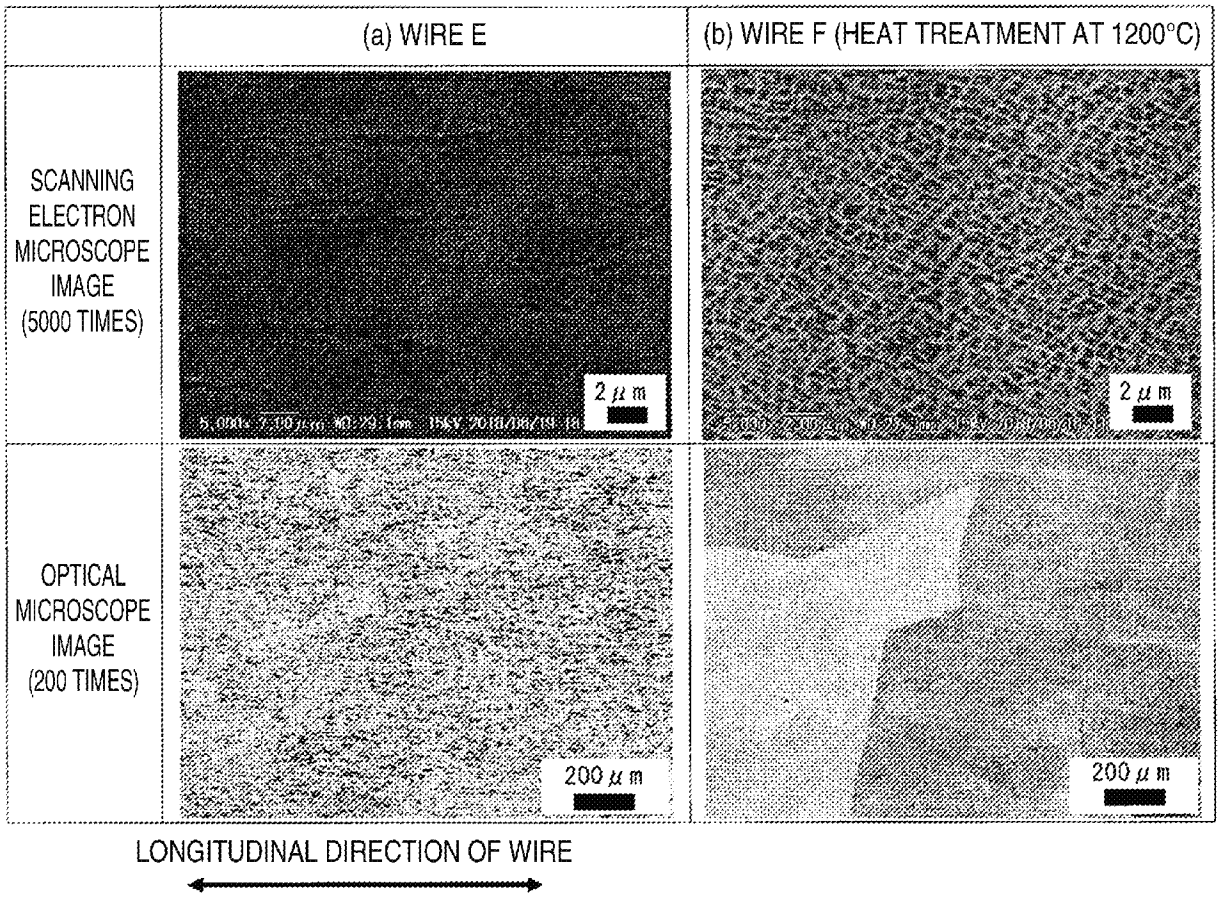
FIG. 3 is a drawing substituting for a photograph, showing an example of a cross-sectional microstructure of a super heat resistant Ni-based alloy wire produced in another example according to the present invention.

FIG. 3 (*a*) shows photomicrographs (SEM image and optical microscope image) of a cross-sectional microstructure of the wire E. A position and direction of the cross-sectional microstructure were the same as those in FIG. 1 (*a*). From the SEM image (at an observation magnification of 5000 times) in FIG. 3 (*a*), a collective flow of gamma prime phase was observed in the cross-sectional structure of the wire E. Thus, it was confirmed that the wire E produced in the example according to the present invention had a plastically worked structure. The gamma prime phase in the SEM image in FIG. 3 (*a*) was observed as a dark color as compared with the gamma prime phase in the SEM images in FIGS. 1 (*a*) and 2 (*a*). As compared with the gamma prime phase of the wires A and C, a gamma prime phase in a large form was observed in the wire E. Such large form gamma prime phase is also extended in the longitudinal direction of the wire. Due to its low carbon content and the like, the presence of carbides was not clearly observed in the optical microscope image (at an observation magnification of 200 times) of the wire E in FIG. 3 (*a*).

Subsequently, the wire E having the plastically worked structure was heat-treated at a temperature of 1200° C. to produce a wire F (heat treatment step). FIG. 3 (*b*) shows photomicrographs (SEM image and optical microscope image) of a cross-sectional microstructure of the wire F. A position and direction of the cross-sectional microstructure were the same as those in FIG. 1 (*b*). As shown in the SEM image (at an observation magnification of 5000 times) and the optical microscope image (at an observation magnification of 200 times) in FIG. 3 (*b*), the cross-sectional structure of the wire F had large grown grains due to recrystallization. A maximum length of the grains was approximately 1000 μm. Thus, it was confirmed that the wire F produced in the example according to the present invention had a recrystallization structure.

<Tensile Strength of Ni-Based Alloy Wire>

Tensile strength of the wires E and F was measured. The tensile test was performed in the same manner as in Example 1. Table 7 shows the results together with hardness of each of the wires.

TABLE 7

| | Cumulative working rate (%) | Wire diameter (mm) | As plastically-worked Hardness (HV) | As plastically-worked Tensile strength (MPa) | Heat treatment at 1200° C. Hardness (HV) | Heat treatment at 1200° C. Tensile strength (MPa) |
|---|---|---|---|---|---|---|
| Wires E and F | 75 | 3.0 | Wire E 578 | 2142 | Wire F 446 | 1028 |

It is shown from Table 7 that, in the wire E produced at a cumulative working rate of not less than 60%, a cast structure was sufficiently eliminated in the structure of the wire and the tensile strength of the wire was not less than 2100 MPa. The wire F produced by heat-treating the wire E had reduced hardness. However, due to the elimination of the cast structure, the tensile strength of the wire was maintained at a sufficient value (e.g., tensile strength of not less than 1000 MPa) corresponding to the reduced hardness.

<Bending Workability of Ni-Based Alloy Wire>

The wires E and F of the example according to the present invention were each subjected to the cantilever bending test as the same manner as in Example 1. As a result of the bending test, none of the wires E and F was broken even when a bending displacement reached 50 mm.

The invention claimed is:

1. A heat resistant Ni-based alloy wire having a recrystallization structure including grains having a maximum length of not less than 100 μm but less than 1500 μm and having a hardness of less than 500 HV, wherein the wire has a composition such that an amount of precipitated gamma prime phase in equilibrium at 700° C. is not less than 35 mol %, wherein the composition comprises, by mass %, 0 to 0.2% of C, 8.0 to 22.0% of Cr, 2.0 to 8.0% of Al, 0.4 to 7.0% of Ti, 0 to 28.0% of Co, 2.0 to 7.0% of Mo, 0 to 6.0% of W, 0 to 4.0% of Nb, 0 to 3.0% of Ta, 0 to 10.0% of Fe, 0 to 1.2% of V, 0 to 1.0% of Hf, 0 to 0.300% of B, 0 to 0.300% of Zr, and the balance of Ni and impurities.

2. The Ni-based alloy wire according to claim 1, wherein the wire is not broken when a bending displacement reaches 50 mm in a cantilever beam bending test, wherein the bending test comprises: preparing a heat resistant Ni-based alloy wire having a length of 150 mm; fixing a portion 25 mm distant from one end of the wire; and applying a load at a portion 25 mm distant from the other end of the wire.

3. A method of manufacturing a heat resistant Ni-based alloy wire, the method comprising:

preparing a bar material of a heat resistant Ni-based alloy;

plastically working the bar material to reduce a cross-sectional area of the bar material so that the bar material has a final wire diameter, by compressing a peripheral surface toward an axis of the bar material, the working being performed multiple times until a cumulative working rate becomes not less than 60%, each working being performed at a working rate of not more than 30% at a temperature not higher than 500° C., wherein no heat treatment at a temperature higher than 500° C. is performed between the workings; and heat-treating, at a temperature higher than 500° C., the Ni-based alloy wire produced in the plastically working step, wherein the Ni-based alloy has a composition such that an amount of precipitated gamma prime phase in equilibrium at 700° C. is not less than 35 mol %, the composition comprising, by mass %, 0 to 0.2% of C, 8.0 to 22.0% of Cr, 2.0 to 8.0% of Al, 0.4 to 7.0% of Ti, 0 to 28.0% of Co, 2.0 to 7.0% of Mo, 0 to 6.0% of W, 0 to 4.0% of Nb, 0 to 3.0% of Ta, 0 to 10.0% of Fe, 0 to 1.2% of V, 0 to 1.0% of Hf, 0 to 0.300% of B, 0 to 0.300% of Zr, and the balance of Ni and impurities, and wherein the manufactured Ni-based alloy wire has a recrystallization structure including grains having a maximum length of not less than 100 μm but less than 1500 μm and having a hardness of less than 500 HV, such that the manufactured Ni-based alloy wire is the heat resistant Ni-based alloy wire according to claim 1.

4. The method according to claim 3, wherein the working is performed multiple times until a cumulative working rate becomes not less than 70%.

5. A heat resistant Ni-based alloy wire having a recrystallization structure including grains having a maximum length of not less than 100 μm but less than 1500 μm and having a hardness of less than 500 HV, wherein the wire has a composition such that an amount of precipitated gamma prime phase in equilibrium at 700° C. is not less than 35 mol %, wherein the composition comprises, by mass %, 0 to 0.2% of C, 20.0 to 25.0% of Cr, 0.5 to 5.0% of Al, 1.0 to 6.0% of Ti, 10.0 to 28.0% of Co, 0 to 8.0% of Mo, 0.5 to 5.0% of W, 0.1 to 3.0% of Nb, 0 to 3.0% of Ta, 0 to 10.0% of Fe, 0 to 1.2% of V, 0 to 1.0% of Hf, 0 to 0.300% of B, 0.010 to 0.300% of Zr, and the balance of Ni and impurities.

6. The Ni-based alloy wire according to claim 5, wherein the wire is not broken when a bending displacement reaches 50 mm in a cantilever beam bending test, wherein the bending test comprises: preparing a heat resistant Ni-based alloy wire having a length of 150 mm; fixing a portion 25 mm distant from one end of the wire; and applying a load at a portion 25 mm distant from the other end of the wire.

7. A method of manufacturing a heat resistant Ni-based alloy wire, the method comprising:

preparing a bar material of a heat resistant Ni-based alloy;

plastically working the bar material to reduce a cross-sectional area of the bar material so that the bar material has a final wire diameter, by compressing a peripheral surface toward an axis of the bar material, the working being performed multiple times until a cumulative working rate becomes not less than 60%, each working being performed at a working rate of not more than 30% at a temperature not higher than 500° C., wherein no heat treatment at a temperature higher than 500° C. is performed between the workings; and heat-treating, at a temperature higher than 500° C., the Ni-based alloy wire produced in the plastically working step, wherein the Ni-based alloy has a composition such that an amount of precipitated gamma prime phase in equilibrium at 700° C. is not less than 35 mol %, the composition comprising, by mass %, 0 to 0.2% of C, 20.0 to 25.0% of Cr, 0.5 to 5.0% of Al, 1.0 to 6.0% of Ti, 10.0 to 28.0% of Co, 0 to 8.0% of Mo, 0.5 to 5.0% of W, 0.1 to 3.0% of Nb, 0 to 3.0% of Ta, 0 to 10.0% of Fe, 0 to 1.2% of V, 0 to 1.0% of Hf, 0 to 0.300% of B, 0.010 to 0.300% of Zr, and the balance of Ni and impurities, and wherein the manufactured Ni-based alloy wire has a recrystallization structure including grains having a maximum length of not less than 100 μm but less than 1500 μm and having a hardness of less than 500 HV, such that the manufactured Ni-based alloy wire is the heat resistant Ni-based alloy wire according to claim 5.

8. The method according to claim 7, wherein the working is performed multiple times until a cumulative working rate becomes not less than 70%.

* * * * *